US005845807A

United States Patent [19]

De Villiers

[11] Patent Number: 5,845,807

[45] Date of Patent: Dec. 8, 1998

[54] DRINKING CUP WITH POURING SPOUT

[75] Inventor: Luis De Villiers, Miami, Fla.

[73] Assignee: Latin Business Systems Inc., Miami, Fla.

[21] Appl. No.: 977,766

[22] Filed: Nov. 25, 1997

[51] Int. Cl.[6] ..... B65D 25/42

[52] U.S. Cl. ..... 220/703; 220/719; 220/DIG. 5; 222/571

[58] Field of Search ..... 222/566, 571, 222/572, 574; 220/DIG. 5, 703, 719, 716

[56] References Cited

U.S. PATENT DOCUMENTS

| | | | |
|---|---|---|---|
| 2,839,230 | 6/1958 | Pottle | 222/574 |
| 2,889,080 | 6/1959 | Livingstone | 222/572 |
| 3,391,838 | 7/1968 | Gundel | 222/571 |
| 3,858,767 | 1/1975 | Borin | 222/572 |
| 4,630,761 | 12/1986 | Thomson | 222/572 |

FOREIGN PATENT DOCUMENTS

| | | | |
|---|---|---|---|
| 637703 | 9/1963 | France | 222/572 |
| 271975 | 6/1927 | United Kingdom | 222/572 |

*Primary Examiner*—Stephen J. Castellano
*Attorney, Agent, or Firm*—Robert M. Downey, P.A.

[57] ABSTRACT

A cup includes a spout integrally formed in an upper zone of the cup's side wall, the spout including a fluid directing channel extending upwardly and outwardly from an inner surface of the side wall at an angle relative to a vertical axis of the cup which causes the velocity of fluid flow to increase as the fluid enters the channel and flows towards a distal tip of the spout, thereby reducing the required degree of tilt of the cup when pouring or drinking fluids therefrom. A lip on the distal spout tip includes acute angled surfaces which, in conjunction with the increased flow velocity of the fluid through the spout, cause the fluid to separate from the cup when pouring, thereby discouraging flow of the fluid down along an outer surface of the cup. A plurality of shoulders formed at spaced intervals on an outer side of the spout create a fluid capture area for entrapping droplets of fluid which fail to detach from the cup and flow over the lip and down the side of the cup.

4 Claims, 1 Drawing Sheet

DRINKING CUP WITH POURING SPOUT

BACKGROUND OF THE INVENTION

1. Field of the Invention

The present invention relates to cups having a pouring spout and, more particularly, to polystyrene cups having an integrally formed spout and means on the spout for detaching fluid from a top lip of the spout when fluid is poured therefrom, thereby reducing the tendency of fluid to flow down the outer surface of the cup.

2. Description of the Related Art

Most cups, and particularly polystyrene cups, have a side wall structure which extends substantially vertically to a base to an open top end. The vertical angle of inclination of the cup's side walls requires the cup to be tilted substantially from the vertical upright position when drinking or pouring fluids from the cup. Furthermore, the length of arc along the lip of the cup over which the fluid flows, when drinking or pouring from the cup, is rather substantial, which makes it difficult to direct the flow of fluid into one's mouth or into another receptacle when pouring the fluid contents from the cup. For instance, when drinking a beverage from a polystyrene cup, in a reclined or partially reclined position, it is necessary to tilt the cup to a significant degree until such time as a large volume of the fluid beverage rushes towards the lip of the cup in a stream of flow which is usually wider than the person's mouth. This often results in spills, particularly when drinking hot beverages, as the person may be startled when encountered with sudden discomfort or pain of the hot beverage striking their lips in an abrupt gush.

Traditional polystyrene cups are not particularly ideal for pouring fluids into another container, especially smaller cups. While the specific gravity and other pouring characteristics vary among fluids, it is well known that some fluids, such as espresso coffee, do not pour well from polystyrene cups. In most instances, espresso coffee contains sugars and other dissolved solids which increases the specific gravity and makes the fluid more viscous. When poured out of a traditional styrofoam (polystyrene) cup, the espresso coffee, rather than pouring out and separating from the cup, remains attached to the cup and flows around the lip and along the outer side of the cup. This results in messy coffee spills and stains on table cloths, counters, and clothing. Moreover, once the fluid has established a path along the outer side, further fluid which is poured from the cup will preferentially follow the established path.

Accordingly, there is an urgent need in the art for an improved cup, and particularly, an improved polystyrene cup, having a spout which changes the angle of flow of fluid from the cup, thereby reducing the required degree of tilt of the cup when pouring or drinking fluids therefrom. There is a further need for a polystyrene cup having a spout with a lip which is structured and disposed to promote detaching of fluid from the cup when pouring, thereby discouraging flow of the fluid down the outer side of the cup.

SUMMARY OF THE INVENTION

The present invention is directed to a cup which includes a spout integrally formed in an upper zone of the cup's side wall. The spout is provided with a fluid directing channel that extends upwardly and outwardly from an inner surface of the side wall and at an angle which causes the velocity of fluid flow to increase as the fluid enters the channel and flows towards a distal tip of the spout. Thus, the degree of tilt of the cup which is require, when pouring or drinking fluids therefrom, compared to a conventional cup, is substantially reduced. A lip on the distal spout tip includes acute angled surfaces which, in conjunction with the increased flow velocity of the fluid through the spout, cause the fluid to separate from the cup when pouring, thereby discouraging flow of the fluid down along an outer surface of the cup. A plurality of shoulders formed at spaced intervals on an outer side of the spout create a fluid capture area for entrapping droplets of fluid which fail to detach from the cup and flow over the lip and down the side of the cup.

With the foregoing in mind, it is a primary object of the present invention to provide a cup having an integrally formed spout which provides an improved path of flow of fluid from the cup, to thereby enhance the ability to pour fluid contents from the cup, while also making it easier to drink fluids from the cup.

It is a further object of the present invention to provide a cup, and particularly a polystyrene cup, having a spout integrally formed in the side wall structure, at an upper zone thereof, wherein the spout increases the surface area of the fluid directly in contact with ambient air to reduce cooling time of hot fluid contained in the cup.

It is still a further object of the present invention to provide a spout on a cup which is specifically structured to cause exiting fluid to reach the lip of the spout at an increased velocity, thus reducing the tendency of the fluid to remain attached to the cup.

It is yet a further object of the present invention to provide a spout integrally formed on a cup, and particularly a polystyrene cup, wherein the spout is structured and disposed to channel the flow of fluid in a directional, predictable manner, thereby making it easier to drink fluids from the cup, and improving the ability to pour fluids from the cup into a smaller receptacle.

It is still a further object of the present invention to provide a cup, with an integrally formed spout, wherein the angle of tilt measured from a vertical upright position, that is required in order to pour fluids from the spout is significantly less than the required tilt angle when pouring fluids from a conventional cup.

It is still a further object of the present invention to provide polystyrene cup, having an integrally formed spout therein, wherein the spout includes means for entrapping fluid on the outer surface of the spout so that the fluid does not flow down the outer side wall of the cup.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
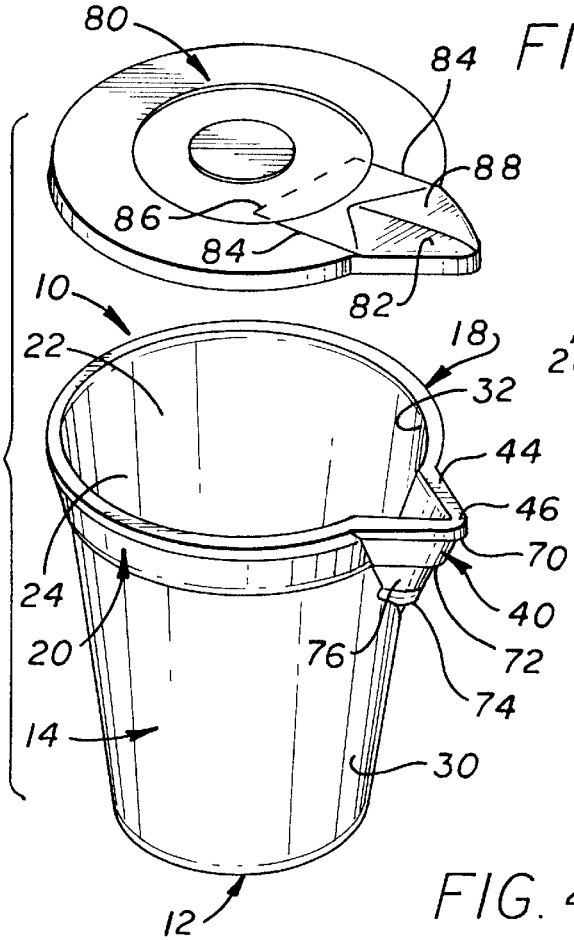
FIG. 1 is an exploded top perspective view showing the cup of the present invention and a lid for attachment to the cup in order to cover the open top thereof.
Figure 2:
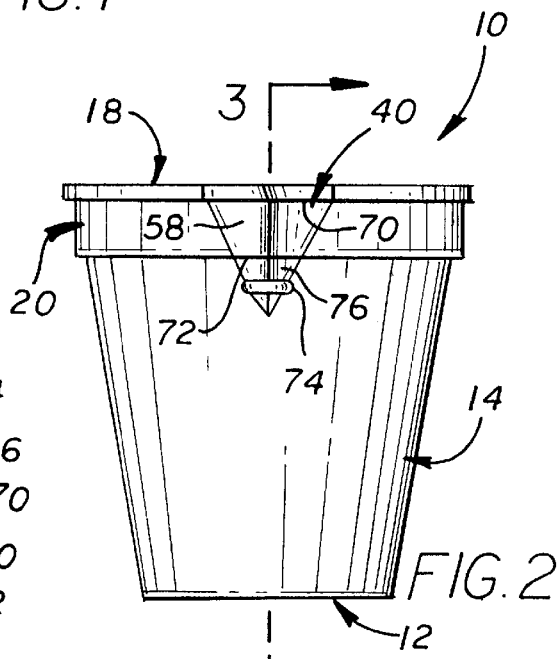
FIG. 2 is a side elevational view of the cup.

Referring to the several views of the drawings, the present invention, directed to a drinking cup, is shown and generally indicated as 10. The cup, in a preferred embodiment, is formed of polystyrene and includes a bottom 12 and a generally cylindrical side wall structure 14 having a generally frustoconical configuration, wherein the radius of the wall structure 14, measured radially from a central vertical axis 16, progressively increases from the bottom 12 to a top rim 18. The top rim 18, on an upper zone 20, is disposed in surrounding relation to an open top 22 of the cup 10. The bottom and side wall structure serve to enclose a fluid containment chamber 24 for containing fluids, such as hot and cold beverages therein. The central vertical axis 16 extends upwardly from a center of the bottom through the open top and is normally disposed in upright vertical alignment with the field of gravity to keep fluids from spilling or pouring from the containment chamber 24. The side wall structure of the cup includes an outer surface 30 and an inner surface 32, the inner surface 32 being disposed at a predetermined angle of inclination from the bottom 12 to the top rim 18. The angle of inclination of the inner surface is preferably less than 90° relative to the bottom of the cup, and is therefore not parallel with the central vertical axis.

Figure 5:
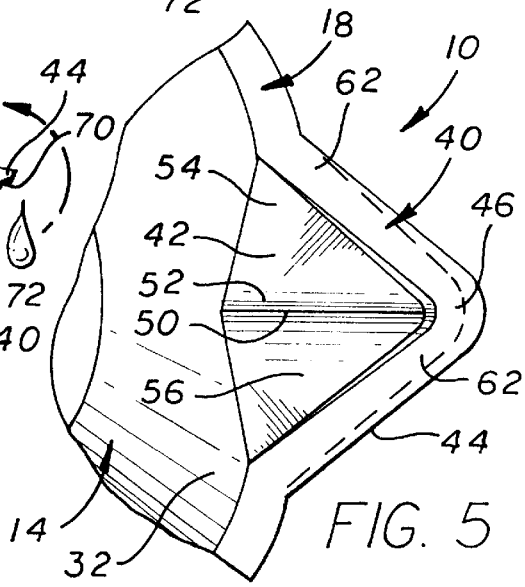
FIG. 5 is an isolated top plan view of the spout.

A spout 40 is integrally formed with the side wall structure 14, at the upper zone 20 and protrudes outwardly from the wall structure and top rim 18. When viewed from the top, as seen in FIG. 5, the configuration of the spout 40 forms a generally triangular spout opening 42 protruding outwardly from the circular top opening 22 of the cup. This protruding spout opening 42 provides a convenient means for sipping fluids from the cup. A top lip 44 surrounds the spout opening 42 and is integral with the top rim 18 of the cup on opposite sides of the spout opening. The top lip 44 extends outwardly to an outermost distal spout tip 46. As seen in FIG. 5, a crease 50 on the inner surface of the spout forms a channel 52 which extends upwardly and outwardly from the inner surface 32 of the side wall structure to the distal spout tip 46 at an angle which is of a reduced inclination relative to the angle of inclination of the inner wall surface. The channel 52 is formed by opposite side faces 54, 56 on the inner surface of the spout, the opposite side faces being angled relative to one another and the inner side wall surface 32. The channel 52 serves to direct fluid flow to the distal spout tip 46 in a generally narrow flow path, thereby making it easier to drink fluids from the spout. The directionalized flow of fluids from the spout further enhances the ability to pour fluid from the cup into other containers or vessels, such as smaller 1–2 oz. shot glasses. The angle of inclination of the channel 52 further serves to increase the velocity of fluid flow as the fluid enters the spout 40 from the containment chamber 24. This is due to the change in angle of inclination of the channel relative to the inner wall surface. The spout opening 42 further serves to increase the surface area of the fluid, when the cup is filled, thereby reducing the time required to cool hot beverages to a temperature which is suitable for drinking.

Figure 3:
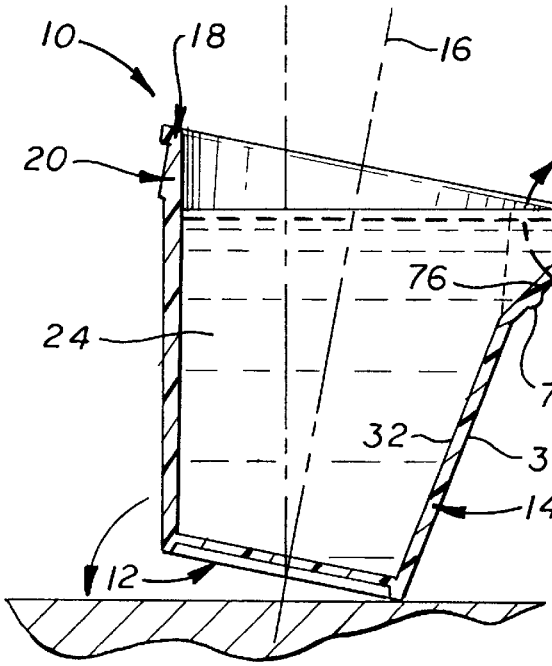
FIG. 3 is a sectional view, taken along the plane indicated by the line 3—3 of FIG. 2, wherein the cup is tilted from an upright position in order to pour contents from the spout.
Figure 4:
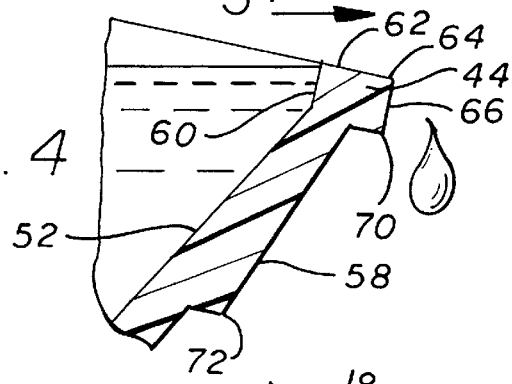
FIG. 4 is an isolated view, taken from the area indicated as 4 of FIG. 3, showing the lip of the spout with fluid detaching from the lip when pouring liquid from the spout.

The spout 40 is particularly designed to prevent fluids from flowing down the outer side 30 of the cup when pouring the fluid contents. This is achieved by use of both means for detaching fluid from the top lip of the spout as well as means to entrap any fluid which flows over the spout lip and down the outer surface 58 of the spout. The means for detaching fluid from the top lip when fluid is poured from the spout includes an inner lip surface 60 between the channel 52 and upper lip surface 62. The inner lip surface 60 is disposed at an angle relative to the channel as well as an acute angle relative to the upper lip surface 62. The angled disposition of this inner lip surface serves to create a slight barrier as fluid flows from the distal spout tip so that when the cup is moved from a tilted, pouring position to the upright position (as seen in FIG. 3), the flow of fluid over the spout lip 44 is cut or detached, thereby effectively separating the fluid from the cup so that it does not flow down the outer surface. An acute angle and the junction 64 between the upper lip surface 62 and an outer lip surface 66 further enhances fluid separation from the cup. A first shoulder 70 and a second shoulder 72 on the outer surface 58 of the spout further serves to detach droplets which run down the outer side of the spout, allowing the droplets to drip into the receiving vessel or container below the spout.

The means for capturing fluid on the outer surface 58 of the spout includes a rib forming a third shoulder 74 that is at a spaced distance below the second shoulder 72. An area of depression 76 is formed on the outer surface of the spout, between the second and third shoulders which serves to entrap fluid droplets that may fail to detach from the cup and which run down the outer surface of the spout.

As seen in FIG. 1, a lid 80 may be provided to cover the open top 22 of the cup, including the spout opening 42. The lid, in a preferred embodiment, is manufactured of plastic, much like a conventional lid for polystyrene cups. Unlike conventional lids, the lid 80 seen in FIG. 1 includes a beak 82 which extends outwardly from the circular body of the lid to cover the spout opening. A perforated break-away seam 84 extends inwardly from the beak so that the beak 82 to a hinge means 86 can be pulled back, as a flap 88, to uncover the spout opening, thereby enabling a user to drink the fluid contents from the spout or to pour the fluid contents from the spout. Means may be provided to enable locking of the flap 88 in an open position to avoid obstruction when drinking from the spout.

While the instant invention has been shown and described in what is considered to be a preferred and practical embodiment thereof, it is recognized that departures may be made within the spirit and scope of the present invention which, therefore, should not be limited excepted as set forth in the following claims and under the doctrine of equivalents.

Now that the invention has been described,

What is claimed is:

1. A cup for containing fluid comprising:

a bottom and a side wall structure extending upwardly from the bottom to an upper zone including a rim surrounding an open top of the cup and a central vertical axis extending from said bottom and through an interior fluid containment chamber of said cup, said side wall structure including an inner surface and an outer surface, said inner surface being disposed at a first angle relative to said central vertical axis;

a spout integrally formed with said side wall structure, at said upper zone, and forming a spout opening in said open top of said cup, said spout including a top lip having an inner lip surface and a top lip surface, said top lip extending outwardly from said rim, at opposite sides of said spout opening, to a distal spout tip;

means for detaching fluid from said top lip when the fluid is poured from said spout to thereby discourage fluid from flowing around said top lip and along said outer surface of said wall structure and including an acute angled edge formed between said inner lip surface and said top lip surface;

means for detaching fluid from said outer surface of said spout and including a plurality of shoulders each being defined by a change in an angle of said outer surface; and fluid capture means on an outer surface of said spout below said distal spout tip for entrapping fluid which flows down said outer surface of said spout, to thereby prevent fluid from flowing down along said outer surface of said wall structure.

2. A cup for containing fluid comprising:

a bottom and a side wall structure extending upwardly from the bottom to an upper zone including a rim surrounding an open top of the cup and a central vertical axis extending from said bottom and through an interior fluid containment chamber of said cup, said side wall structure including an inner surface and an outer surface, said inner surface being disposed at a first angle relative to said central vertical axis;

a spout integrally formed with said side wall structure, at said upper zone, and forming a spout opening in said open top of said cup, said spout including a top lip, with an upper lip surface, said top lip extending outwardly from said rim, at opposite sides of said spout opening, to a distal spout tip, and said spout further including a channel for directing flow of the fluid from said interior fluid containment chamber to said distal spout tip, said channel extending from below said upper zone on said inner surface of said wall structure to said top lip at said distal spout tip, and said channel being disposed at a second angle relative to said central vertical axis, said second angle being greater than said first angle of said inner surface to cause an increase in velocity of the fluid when flowing along said channel of said spout towards said distal spout tip, and said spout further including first and second inner spout faces on opposite sides of said channel;

means for detaching fluid from said top lip when the fluid is poured from said spout to thereby discourage fluid from flowing around said top lip and along said outer surface of said wall structure;

means for detaching fluid from said outer surface of said spout including a plurality of shoulders, each of said plurality of shoulders being defined by a change in an angle of said outer surface, said change in angle being greater than 45°;

fluid capture means on an outer surface of said spout below said distal spout tip and being defined by areas between said plurality of shoulders, said fluid capture means being structured for entrapping fluid which flows down said outer surface of said spout, to thereby prevent fluid from flowing down along said outer surface of said wall structure; and said cup being formed of polystyrene.

3. A cup as recited in claim 2 wherein said means for detaching fluid from said top lip includes an inner lip surface between said channel and said upper lip surface, said inner lip surface being disposed at an angle relative to said channel, said first and second inner spout faces and said upper lip surface to interrupt the flow of fluid and detach the fluid from said top lip upon moving the cup from a tilted, pouring orientation towards an upright orientation.

4. A cup for containing fluid comprising:

a bottom and a side wall structure extending upwardly from the bottom to an upper zone including a rim surrounding an open top of the cup and a central vertical axis extending from said bottom and through an interior fluid containment chamber of said cup, said side wall structure including an inner surface and an outer surface, said inner surface being disposed at a first angle relative to said central vertical axis;

a spout integrally formed with said side wall structure, at said upper zone, and forming a spout opening in said open top of said cup, said spout including a top lip, with an upper lip surface, said top lip extending outwardly from said rim, at opposite sides of said spout opening, to a distal spout tip, and said spout further including a channel for directing flow of the fluid from said interior fluid containment chamber to said distal spout tip, said channel extending from below said upper zone on said inner surface of said wall structure to said top lip at said distal spout tip, and said channel being disposed at a second angle relative to said central vertical axis, said second angle being greater than said first angle of said inner surface to cause an increase in velocity of the fluid when flowing along said channel of said spout towards said distal spout tip, and said spout further including first and second inner spout faces on opposite sides of said channel;

means for detaching fluid from said top lip when the fluid is poured from said spout to thereby discourage fluid from flowing around said top lip and along said outer surface of said wall structure;

means for detaching fluid from said outer surface of said spout and including a plurality of shoulders, each of said plurality of shoulders being defined by a change in an angle of said outer surface, said change in angle being greater than 45°; and fluid capture means on an outer surface of said spout below said distal spout tip and being defined by areas between said plurality of shoulders, said fluid capture means being structured for entrapping fluid which flows down said outer surface of said spout, to thereby prevent fluid from flowing down along said outer surface of said wall structure.

* * * * *